United States Patent [19]

Ramacciotti et al.

[11] 4,055,215

[45] Oct. 25, 1977

[54] HOT-TOP FOR THE PRODUCTION OF INGOTS USING AN ELECTROSLAG REMELTING PROCESS

[75] Inventors: Aldo Ramacciotti; Eugenio Repetto, both of Rome, Italy

[73] Assignee: Centro Sperimentale Metallurgico S.p.A., Rome, Italy

[21] Appl. No.: 705,263

[22] Filed: July 14, 1976

[30] Foreign Application Priority Data

July 23, 1975 Italy ..... 50628/75

[51] Int. Cl.[2] ..... B22D 27/02

[52] U.S. Cl. ..... 164/252; 13/9 ES

[58] Field of Search ..... 164/52, 252; 249/197; 13/9 ES

[56] References Cited

U.S. PATENT DOCUMENTS

| | | | |
|---|---|---|---|
| 2,380,238 | 7/1945 | Hopkins | 164/52 |
| 3,739,833 | 6/1973 | Rausch et al. | 249/197 X |

*Primary Examiner*—Robert D. Baldwin

*Attorney, Agent, or Firm*—Young & Thompson

[57] ABSTRACT

A hot-top for the production of ingots using an electroslag remelting process, comprises a ceramic hot-top having non-consumable electrodes embedded in the radially inner side walls thereof, the exposed surfaces of the electrodes comprising 5 to 50% of the total area of the hot-top inner surface. The electrodes extend parallel to the axis of the hot-top, from the top edge of the hot-top down at least 50% of the height thereof, and may be graphite or hollow water-cooled metal electrodes. In use, the electrodes contact not only the molten metal but also its superposed layer of slag.

8 Claims, 2 Drawing Figures

HOT-TOP FOR THE PRODUCTION OF INGOTS USING AN ELECTROSLAG REMELTING PROCESS

Figure 1:
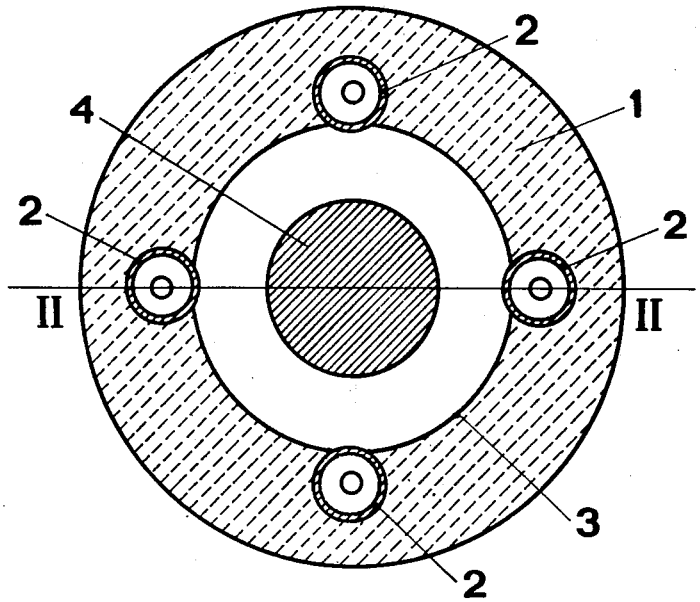

The present invention relates to hot-tops or the production of ingots using an electroslag remelting process (hereinafter referred to as "ESR"-process).

The ESR process consists in melting metal electrode using the heat produced by the Joule effect of an electric current which is caused to pass from the consumable electrode to the metal base of an ingot mold through a bath of electroconductive slag. Particularly for use in the production of very large ingots, a combination method has been suggested in which a greater part of the ingot is cast from a transfer ladle in the usual way, but casting is completed with the ESR process, using a metal electrode of the desired composition.

Two casting techniques are possible:

— casting in a water-cooled (or at least partially water-cooled) ingot mold without a hot-top;

— casting in a mold fitted with a hot-top of refractory material.

In both cases, the electric current is conducted:

— either from the consumable electrode to the base of the mold;

— or between three electrodes, if three-phase AC power is used.

There are several disadvantages associated with the use of these melting processes, the following three being the most troublesome:

— If an ingot mold, without a hot-top and having its upper part water cooled, is used, the horizontal cross-section of said upper part must be sufficiently large to prevent formation of solid "bridges"enclosing pockets of molten metal. This requirement increases the pick-up of hydrogen from ambient humidity considerably; in addition, higher-than-normal voltages and current intensities must be adopted to compensate for the heat absorbed by the cooling water from the upper part of the mold.

— When the current is conducted from the consumable electrode to the base of the mold, the current flowing through molten pool generates a magnetic field which in turn sets up strong ascending/descending flows in the molten metal. As a result, slag particles and other solid impurities tend to be entrained by the molten metal and to become lodged in the main body of the ingot, thus forming along the ingot's vertical axis inclusions, spongy layers and other internal defects.

— If three-phase AC power is used, the three electrodes required in this case generate a rotary flow in the slag layer which rapidly wears down the refractory lining of both the hot-top and the upper part of the mold. Furthermore, the horizontal cross-sectional area must be sufficiently wide to accommodate all three electrodes thereby causing increased hydrogen pick-up from the surrounding atmosphere.

The new hot-top of the present invention has been designed with the object of eliminating these disadvantages by serving the following purposes:

— to restrict the electric current flow to a limited area of the upper part of the ingot;

— to reduce the horizontal cross-sectional area at the top of the hot-top so as to minimize hydrogen pick-up; and — to moderate vertical flows in the molten metal, scaling them down to the level sufficient for obtaining a homogeneous ingot and for floating up to the top slag layer any impurities present in the molten pool.

How these main purposes are served will be explained in the detailed description which follows and which will provide also an opportunity for pointing out other additional advantages of the invention.

According to the present invention, the inner surface of the hot-top is fitted with a number of separate parallel electrical conductors extending from the upper edge of the hot-top down at least 50% of its overall height and consisting in the exposed portions of non-consumable electrodes embedded in the refractory material forming the hot-top wall. Graphite or water-cooled metal electrodes may be used, as well as composite electrodes (i.e. part graphite and part metal).

The total exposed surface of the electrodes can range from 5 to 50% of the total inner surface area of the hot-top.

Figure 2:
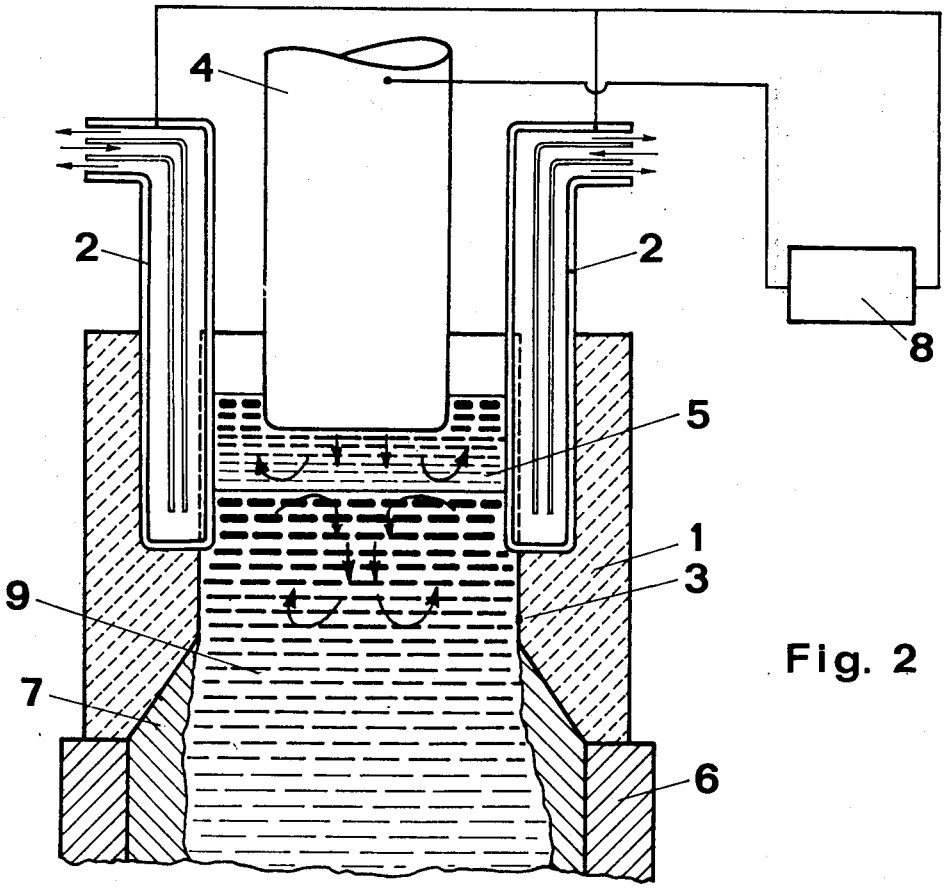

These and other features and advantages of the present invention will become apparent from a consideration of the following description, taken in connection with the accompanying drawing, in which:

FIG. 1 is a horizontal transverse cross-sectional view of a hot-top according to the present invention; and FIG. 2 is a cross-sectional view taken on the line 2—2 of FIG. 1.

Referring now to the drawing in greater detail, there is shown a hot-top 1 according to the present invention having a refractory wall in which are embedded a plurality of non-consumable electrodes 2, a portion of the external surface of the electrodes 2 protruding from or being substantially flush with the radially inner walls 3 of the hot-top. The electrodes shown in FIGS. 1 and 2 are of circular cross section; however, electrode sections other than circular may be selected, e.g., trapezoidal, annular, etc.

A central consumable electrode 4 continuously renews the supply of molten metal to the ingot body and is disposed in the central cavity of the hot-top spaced from the side walls thereof. The non-consumable electrodes 2, which in this embodiment protrude from the hot-top inner face and are water-cooled metallic electrodes, are aligned parallel to the axis of the hot-top and to that of consumable electrode 4. The actual positioning of the non-consumable electrodes 2 relative to electrode 4 is shown more clearly in FIG. 2.

The central cavity of the hot-top, as seen in FIG. 2, contains also the electroslag bath 5 and the top layer of the molten metal pool 9, which latter is seen solidifying at 7 against the wall of the mold 6. The tip of the consumable electrode is immersed in the electroslag bath; while the non-consumable electrodes are in contact both with the electroslag bath 5 and with the molten pool 9.

Electric circuit through consumable electrode 4 and non-consumable electrodes 2 is completed as seen in FIG. 2, the circuit being powered by a DC or an AC generator 8.

The electrode layout described above: (i) drastically scales down circulatory flows within the molten metal (see the arrows in FIG. 2); (ii) produces an improved solidification structure and reduces the quantity of non-metallic inclusions; and (iii) cuts down the reactance and impedance of the electric circuit.

By using hollow water-cooled metal non-consumable electrodes, sufficient heat is subtracted from the hot-top to substantially reduce wear of its inner face. Despite this cooling effect, the hot-top retains all the advantages of an ordinary non-cooled hot-top made up entirely of refractory material (lower power requirements, reduced probability of solid "bridges" forming within the molten pool, less surface area exposed to ambient atmosphere, etc.), since the total area of contact between the non-consumable electrodes and the electroslag bath and/or the molten pool is relatively small.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

We claim:

1. A hot-top for the production of ingots obtained at least in part by an electroslag remelting process, the hot-top being made of refractory material and having on its inner surface a plurality of non-consumable elongated electrodes partially embedded in said refractory material, said electrodes having exposed parts constituting a plurality of elongated vertical parallel electrically conducting zones that extend from the upper edge of the hot-top downwardly, a consumable electrode having its lower end disposed axially within said hot-top and spaced from the inner side walls of the hot-top, and means for passing an electric current between said consumable and non-consumable electrodes, said consumable electrode being in series with a plurality of said non-consumable electrode, a plurality of said non-consumable electrodes being in parallel with each other.

2. A hot-top as claimed in claim 1, said non-consumable electrodes extending lower than said consumable electrode.

3. A hot-top as claimed in claim 1, said consumable electrode being in series with each of said non-consumable electrodes, all said non-consumable electrodes being in parallel with each other.

4. A hot-top as claimed in claim 1, said zones extending for at least 50% of the overall height of the hot-top.

5. A hot-top as claimed in claim 1, said non-consumable electrodes being graphite electrodes.

6. A hot-top as claimed in claim 1, said non-consumable electrodes being hollow water-cooled metal electrodes.

7. A hot-top as claimed in claim 1, in which the total exposed surface area of the non-consumable electrodes is from 5 to 50% of the total area of the hot-top inner surface.

8. A hot-top as claimed in claim 1, which is annular, said non-consumable electrodes being disposed in an equally spaced series about the inner periphery of the hot-top.

* * * * *